US009255397B2

(12) United States Patent
Bauman et al.

(10) Patent No.: US 9,255,397 B2
(45) Date of Patent: Feb. 9, 2016

(54) TRUSS TOWER LEG REINFORCING SYSTEM

(71) Applicants: Kevin P. Bauman, Columbus, OH (US); Curtis J. Porr, Pickerington, OH (US)

(72) Inventors: Kevin P. Bauman, Columbus, OH (US); Curtis J. Porr, Pickerington, OH (US)

(73) Assignee: Aerosolutions, LLC, Boulder, CO (US)

( * ) Notice: Subject to any disclaimer, the term of this patent is extended or adjusted under 35 U.S.C. 154(b) by 0 days.

(21) Appl. No.: 14/027,562

(22) Filed: Sep. 16, 2013

(65) Prior Publication Data

US 2014/0075880 A1 Mar. 20, 2014

Related U.S. Application Data

(63) Continuation of application No. 12/943,988, filed on Nov. 11, 2010, now Pat. No. 8,534,026, which is a continuation of application No. 11/871,288, filed on Oct. 12, 2007, now abandoned.

(60) Provisional application No. 60/829,451, filed on Oct. 13, 2006.

(51) Int. Cl.

| | |
|---|---|
| ***E04H 12/10*** | (2006.01) |
| ***E04B 1/92*** | (2006.01) |
| ***E04C 3/32*** | (2006.01) |
| ***E04H 12/00*** | (2006.01) |

(52) U.S. Cl.

CPC ... *E04B 1/92* (2013.01); *E04C 3/32* (2013.01); *E04H 12/00* (2013.01); *E04H 12/10* (2013.01)

(58) Field of Classification Search

CPC ..... E04B 1/19; E04B 2001/1987; E04B 1/92; E04C 2003/02; E04C 2003/0486; E04C 3/32; E04H 12/10; E04H 12/08; E04H 12/32; E04H 12/342; E04H 2012/006; E04H 12/00

USPC ..... 52/836, 651.04, 651.07, 654.1, 690, 52/223.4, 652.1, 651.02, 651.11, 849, 848

See application file for complete search history.

(56) References Cited

U.S. PATENT DOCUMENTS

| | | | | | |
|---|---|---|---|---|---|
| 835,280 | A | * | 11/1906 | Broderick | 52/651.04 |
| 835,281 | A | * | 11/1906 | Broderick | 52/651.04 |
| 1,658,535 | A | * | 2/1928 | Neilson, Sr. | 52/223.4 |
| 1,693,107 | A | * | 11/1928 | Campbell | 52/638 |
| 1,963,014 | A | * | 6/1934 | Brown | 343/723 |
| 2,086,009 | A | * | 7/1937 | Walker | 52/292 |
| 2,194,810 | A | * | 3/1940 | Reiner | 52/695 |
| 2,387,120 | A | | 10/1945 | Cohen | |
| 2,857,994 | A | * | 10/1958 | Sheard | 52/40 |
| 3,360,288 | A | * | 12/1967 | Holscher | 52/638 |
| 3,371,458 | A | * | 3/1968 | Sturgill | 52/651.01 |
| 3,490,189 | A | * | 1/1970 | Gostling | 52/655.1 |
| 3,670,471 | A | * | 6/1972 | Smith | 52/638 |
| 4,216,636 | A | * | 8/1980 | Cordell | 52/637 |
| 5,375,353 | A | * | 12/1994 | Hulse | 40/217 |
| 5,787,673 | A | * | 8/1998 | Noble | 52/848 |
| 5,832,688 | A | * | 11/1998 | Crissey et al. | 52/651.01 |
| 5,894,703 | A | * | 4/1999 | Lieb et al. | 52/651.01 |
| 6,108,996 | A | * | 8/2000 | McGinnis | 52/651.02 |
| 6,935,025 | B1 | * | 8/2005 | Watson et al. | 29/897.31 |

(Continued)

*Primary Examiner* — Robert Canfield
*Assistant Examiner* — Babajide Demuren
(74) *Attorney, Agent, or Firm* — Lathrop & Gage LLP

(57) ABSTRACT

A reinforced triangular truss column having two vertical pipe reinforcing columns added to the three rods of the truss column is provided. Also provided is a method of reinforcing triangular truss columns comprising adding two vertical pipe reinforcing columns to a triangular truss column.

6 Claims, 2 Drawing Sheets

(56) References Cited

U.S. PATENT DOCUMENTS

| | | | | |
|---|---|---|---|---|
| 6,944,950 | B1 * | 9/2005 | Watson et al. | 29/897.31 |
| 7,253,786 | B1 | 8/2007 | Logozzo | |
| 7,581,360 | B2 * | 9/2009 | Olsen | 52/111 |
| 2002/0069596 | A1 * | 6/2002 | Ritz | 52/148 |
| 2002/0170261 | A1 | 11/2002 | Brunozzi et al. | |
| 2004/0020158 | A1 | 2/2004 | Kopshever | |
| 2004/0134155 | A1 | 7/2004 | Lockwood et al. | |
| 2008/0184653 | A1 | 8/2008 | Bauman et al. | |
| 2011/0107709 | A1 | 5/2011 | Bauman et al. | |

* cited by examiner

TRUSS TOWER LEG REINFORCING SYSTEM

CROSS-REFERENCE TO RELATED APPLICATIONS

This application is a continuation of U.S. application Ser. No. 12/943,988, filed Nov. 11, 2010, which is a continuation of U.S. application Ser. No. 11/871,288, filed Oct. 12, 2007, which claims the benefit of U.S. provisional application 60/829,451, filed Oct. 13, 2006, all of which are hereby incorporated by reference herein.

BACKGROUND OF THE INVENTION

Several communication tower manufacturers construct triangular self-supporting towers utilizing vertical columns constructed of triangular trusses. These tower columns (often referred to as the tower legs) resemble miniature triangular shop-welded tower sections. When additional loads are added to the tower, these truss legs may no longer be adequate to safely support the calculated tensile or compressive loads. To alleviate this overstress, the structural capacity of the truss columns must be enhanced. Field welding additional steel onto these truss legs is expensive and creates the potential for several problems. The heat of the welding operation destroys the galvanized coating on the existing steel members creating a corrosion problem. The heat of the welding operation may warp the existing steel and the sparks create a fire hazard. This invention was developed to address these problems.

SUMMARY OF THE INVENTION

Provided is a method of reinforcing a triangular truss column comprising: providing two generally vertical pipe reinforcing columns (16) each having a first pipe reinforcing plate attached at the top of the column (17) and a second pipe reinforcing plate at the bottom of the column (17); attaching the first pipe reinforcement plate to a first existing plate (13) of the triangular truss column; attaching the second pipe reinforcement plate to a second existing plate (13) of the triangular truss column; and connecting each vertical pipe reinforcing column to the truss column at one or more connection points along the pipe reinforcing column length. Also provided is a reinforced triangular truss column having two generally vertical pipe reinforcing columns attached to the outside of a portion of a triangular truss column.

The pipe reinforcing columns are connected to the truss column in the vertical direction using any suitable means as known in the art without undue experimentation. Some examples are described and shown herein. As one example, a metal strap or band (18) that spans one side of the triangular truss column is connected to two legs (12) of the triangular truss column (11). The strap or band may be connected to the legs of the triangular truss column using any suitable means, including bolts. The band or strap is any suitable width and thickness that provides the desired amount of support. It is not necessary, and is not preferred, that the metal strap be so wide that that it results in wind resistance or excess weight. In another embodiment, the pipe reinforcing columns are connected to the truss column using a band or strap which surrounds the truss column and the pipe reinforcing columns.

In one embodiment, the pipe reinforcing plates are attached to the existing plate of the triangular truss column using bolts (15). The pipe reinforcing column may be made from any suitable material, and do not need to be made from the same material. Each pipe reinforcing column may be hollow or solid.

As used herein, "generally vertical" or "generally horizontal" indicates the direction does not need to be exactly vertical or exactly horizontal with respect to a fixed point, but includes those situations where there is a small amount of variance, for example, ±10 degrees of variance. Other degrees of variance are included, for example ±5, ±15 and ±20 and all intermediate ranges and values therein.

DETAILED DESCRIPTION OF THE INVENTION

Truss Columns:

A single truss column is constructed of three individual solid round bars shop-welded at the top and bottom to a common plate. These three solid bars are connected to each other with horizontal and diagonal bracing (14) forming a three-dimensional triangular truss. It requires three truss columns to form a single triangular tower section. These tower sections are then stacked vertically and bolted together at the truss column plates.

Solution:

Presented here is a method to enhance the structural capacity of the existing truss columns that does not require field welding. Two vertical pipes are added to the three solid round rods of the truss column. These pipes have plates welded at the top and bottom. Several of the existing truss column splice bolts are removed. A new pipe column is inserted with new longer splice bolts inserted to connect the top and bottom plates of the new pipe column to the top and bottom plates of the truss column. There are also straps or other devices that connect the new pipe column to the truss column at intermediate intervals to prevent the pipe column from buckling away from the existing truss column. These straps are connected to the truss column with U-bolts (19) or other suitable connecting means, as known in the art. This invention is useful for any towers with truss-type legs (columns).

The result is that the truss column is no longer comprised of just three solid round rods (12) but is now is comprised of the original three solid round rods plus two round pipes (16) which may be hollow.

Figure 1:
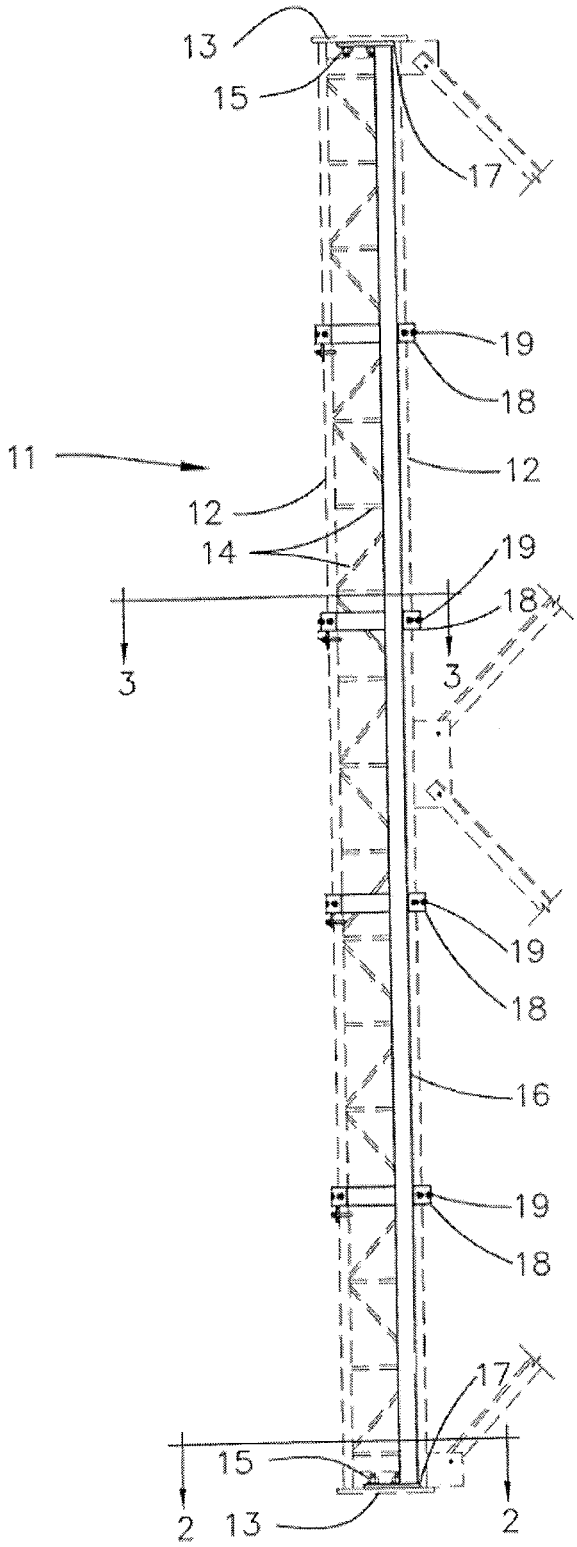
FIG. 1 illustrates a reinforced triangular truss column assembly in elevation view.
Figure 2:
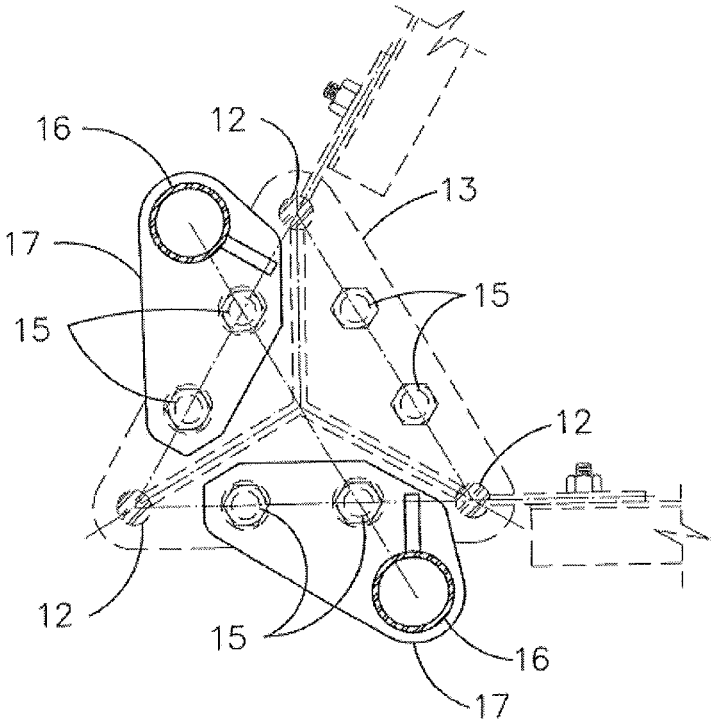
FIG. 2 is a horizontal cross section of the reinforced truss column assembly along line 2-2 of FIG. 1.
Figure 3:
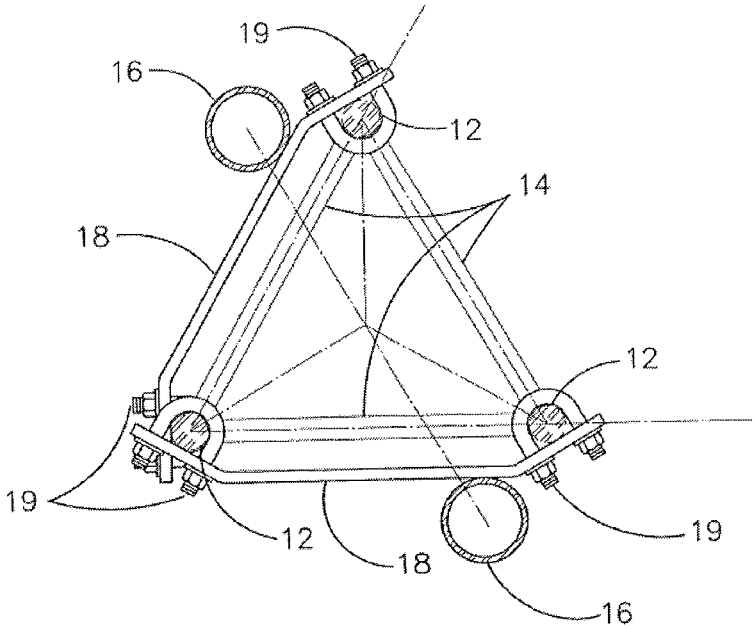
FIG. 3 is a horizontal cross section of the reinforced truss column assembly along line 3-3 of FIG. 1.

FIG. 1 shows one embodiment of the invention. Elevation 1 shows a large-scale view. Elevation 1 shows two sections, section 2 and section 3, also shown in FIG. 1. Section 2 shows the use of the invention at the existing tower leg splice plate (13), as described herein. Section 3 shows an intermediate brace (18), as described herein.

All elements of the invention may be made from any suitable material, as known to one of ordinary skill in the art. The materials used may depend on the environment where the tower is used, as known in the art. The diameters of the vertical pipes (16) may vary, depending on the application. The vertical pipes (16) may be made from any suitable material, as known to one of ordinary skill in the art. The vertical pipes (16) may be metal, composite or polymer, for example. The vertical pipes (16) may be hollow or solid. The connecting bands (18) may be constructed from any suitable material, as known to one of ordinary skill in the art.

Although the invention is described with respect to triangular truss towers (11), it is well known in the art that the invention may be used with four-legged towers, as well, without undue experimentation, using two, three, or four vertical pipe reinforcing columns, using the information provided here and that information known in the art.

It should be understood that although the present description has been disclosed by specific embodiments and optional features, modification and variation of the concepts herein disclosed may be resorted to by those skilled in the art, and that such modifications and variations are considered to be within the scope of this invention.

We claim:

1. A method of reinforcing a triangular truss column comprising:

providing two generally vertical pipe reinforcing columns, wherein each vertical pipe reinforcing column has a first pipe reinforcing plate attached at the top and a second pipe reinforcing plate attached at the bottom, wherein the pipe reinforcing columns are hollow;

attaching the first pipe reinforcement plate of each vertical pipe reinforcing column to a first existing plate of the triangular truss column;

attaching the second pipe reinforcement plate of each vertical pipe reinforcing column to a second existing plate of the triangular truss column;

connecting each vertical pipe reinforcing column to the truss column at one or more connection points along the pipe reinforcing column length, wherein the pipe reinforcing columns are connected to the truss column at the one or more connection points using a generally horizontal band which is connected to two legs of the triangular truss column and surrounds the truss column and the pipe reinforcing columns, wherein legs of the triangular truss column are attached together through leg splice plates.

2. The method of claim 1, wherein the band is attached to the outside of the truss column.

3. The method of claim 1, wherein the band is metal.

4. The method of claim 1, wherein the band is bolted to one or more legs of the truss column.

5. The method of claim 1, wherein the pipe reinforcing columns are each connected to the truss column using a strap which is bolted to two legs of the truss column and spans one side of the triangular truss column.

6. The method of claim 1, wherein the pipe reinforcing plates are attached to the existing plate of the triangular truss column using bolts.

* * * * *